US005750222A

United States Patent [19]

Komatsu et al.

[11] Patent Number: 5,750,222

[45] Date of Patent: May 12, 1998

[54] SEAMLESS CAN WITH NECKED-IN PORTION

[75] Inventors: Ikuo Komatsu, Yokohama; Nobuyuki Sato, Ebina; Katsuhiro Imazu, Yokohama, all of Japan

[73] Assignee: Toyo Seikan Kaisya, Ltd., Tokyo, Japan

[21] Appl. No.: 431,979

[22] Filed: May 1, 1995

[30] Foreign Application Priority Data

May 2, 1994 [JP] Japan ..... 6-113350

[51] Int. Cl.[6] ..... B65D 1/14; B65D 23/02

[52] U.S. Cl. ..... 428/35.8; 428/35.9; 428/335; 428/458; 206/524.3; 220/458; 220/926; 220/DIG. 22; 420/128

[58] Field of Search ..... 220/458, 906, 220/DIG. 22, 415; 206/524.3, 524.4; 420/128; 148/320; 428/35.8, 35.9, 335, 457, 458, 542.8; 72/46

[56] References Cited

U.S. PATENT DOCUMENTS

| | | | |
|---|---|---|---|
| 2,157,896 | 1/1939 | Held | 220/DIG. 22 |
| 3,865,645 | 2/1975 | Takahashi et al. | 148/142 |
| 4,075,041 | 2/1978 | Ueno et al. | 148/12.4 |
| 4,405,058 | 9/1983 | Phalin | 220/458 |
| 4,541,546 | 9/1985 | Imazu et al. | 220/458 |
| 4,768,672 | 9/1988 | Pulciani et al. | 22/DIG. 22 |
| 5,137,762 | 8/1992 | Aizawa et al. | 428/35.8 |
| 5,139,889 | 8/1992 | Imazu et al. | 220/456 |
| 5,144,824 | 9/1992 | Kobayashi et al. | 428/35.8 |
| 5,186,769 | 2/1993 | Hunt et al. | 148/593 |
| 5,228,588 | 7/1993 | Aizawa et al. | 220/458 |
| 5,300,335 | 4/1994 | Miyazawa et al. | 428/35.9 |
| 5,360,649 | 11/1994 | Sato et al. | 428/35.8 |

FOREIGN PATENT DOCUMENTS

| | | |
|---|---|---|
| 1-258822 | 10/1989 | Japan . |
| 4-22519 | 1/1992 | Japan . |

OTHER PUBLICATIONS

Auflage, 10th ed., Germany, 1974.

Encyclopedia of Chemical Technology, vol. 21, p. 612, 1978.

Reed–Hill, Dr. Robert E., Physical Metallurgy Principles, second edition, p. 363, 1973.

*Primary Examiner*—Rena Dye

*Attorney, Agent, or Firm*—Armstrong, Westerman, Hattori, McLeland & Naughton

[57] ABSTRACT

An organic resin-coated seamless can with necked-in portion is disclosed, which is produced by subjecting a resin-coated steel sheet to drawing-re-drawing for reducing thickness or to drawing-re-drawing-ironing for reducing thickness-ironing and which has a ratio of diameter of necked-in portion to diameter of body of 0.9 or less than that, said steel sheet being coated by 5- to 30-μm thick organic resin layer on both surfaces of aluminum-killed, surface-treated steel sheet of 0.01 to 0.13 % by weight in total carbon amount and not more than 6.5 μm in average grain diameter having been subjected to over-aging after continuous annealing to adjust to not more than 10 ppm in solid-dissolved carbon amount. This can scarcely has rough surface or pinholes in the necked-in portion even when the necked-in portion has been considerably compressed upon its formation.

4 Claims, 5 Drawing Sheets

SEAMLESS CAN WITH NECKED-IN PORTION

BACKGROUND OF THE INVENTION

This invention relates to a seamless can with a necked-in portion for filling carbonated drinks, beer, coffee drinks, fruit drinks, etc.

It has been proposed to produce a seamless can having a side wall thinned by bend-stretching, by re-drawing a once drawn metal cap made of organic substance-coated cold-reduced steel sheet using a die having a working corner with a small curvature radius, said cold-rolled steel sheet having an average grain diameter of 6.5 μm or less and a tensile strength of 65 kg/mm$^2$ or more (Japanese Unexamined Patent Publication No. 4-22519). However, this type of seamless can has been found to have the defect that, when subjected to neck-in working in a post-working process, the resulting necked-in portion 13 will be liable to suffer formation of seriously rough surface 6 (see FIG. 1) and, in an extreme case, even pinholes if the degree of neck-in working is large, i.e., the diameter-reducing ratio is more than 10%, particularly more than 15%. Rough surface is unfavorable since it spoils adhesion between the cold-reduced steel sheet base and the organic coating, leading to deterioration of corrosion resistance.

SUMMARY OF THE INVENTION

An object of the present invention is to provide an organic resin-coated seamless can with a necked-in portion, which scarecely suffers formation of rough surface and pinholes in the necked-in portion even when the diameter-reducing ratio of the necked-in portion is large.

The seamless can of the present invention having a necked-in portion is produced by subjecting a resin-coated steel sheet to drawing-re-drawing for reducing thickness or to drawing-re-drawing-ironing for reducing thickness and which has a ratio of diameter of necked-in portion to diameter of body of 0.9 or less than that, said steel sheet being coated by 5- to 30-μm thick organic resin layer on both surfaces of aluminum-killed, surface-treated steel sheet of 0.01 to 0.13% by weight in total carbon amount and not more than 6.5 μm in average crystal size having been subjected to over-aging after continuous annealing to adjust to not more than 10 ppm in solid-dissolved carbon amount.

Other objects, features and advantages of the present invention will become apparent from the detailed description of the preferred embodiments of the invention to follow.

In these Figures, numeral 10 designates a seamless can with a necked-in portion, 11 a body, 13 a necked-in portion, 15 a surface-treated steel sheet, 16 an organic resin layer on the inside surface, and 17 an organic resin layer on the outside surface.

DETAILED DESCRIPTION OF THE PREFERRED EMBODIMENT OF THE INVENTION

The over-aging is preferably conducted at 350°–500° C. The amount of soluble Al is preferably 0.01–0.1% by weight, and the amount of total nitrogen is preferably 0.006% by weight or less than that.

Additionally, in this specification, the term "drawing" includes ordinary re-drawing except for the re-drawing for reducing thickness.

Figure 2:
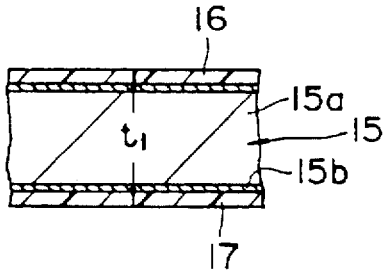
FIG. 2 is an enlarged view of portion A of the seamless can shown in FIG. 1.

As is described in Japanese Unexamined Patent Publication No. 1-258822, the re-drawing for reducing thickness is conducted by using a re-drawing die having a curvature radius Rd of the working corner 1–2.9 times as much as the thickness $t_1$ of the resin-coated steel sheet (substantially the same as $t_1$ shown in FIG. 2).

The re-drawing is specifically described below by reference to FIG. 4. A blank of resin-coated steel sheet having a thickness of $t_1$ is subjected to drawing and ordinary re-drawing to form a re-drawn cup 1 (see FIG. 3 ②). The bottom **1*b* of the re-drawn cup is pressed into cavity 2*c* of a re-drawing die 2 by the top end of a punch 4 while pressing the side wall 1*a* (having a thickness of $t_2$ about the same as $t_1$) of the re-drawn cup 1 by the plane surface 2*a* of the re-drawing die 2 and the lower surface 3*a* of a blank holding member 3 to thereby conduct bending-unbending at a working corner 2*b* having a small curvature radius under a comparatively large back tension $S_1$ and a front tension $S_2$. Thus, thickness of the side wall 1*a*** is thinned to $t_3$. The thickness-reducing ratio $\{(t_1-t_3)\times 100/t_1\%\}$ is usually 15 to 40%.

In ordinary re-drawing, reduction in thickness of steel sheet by the bending-unbending deformation at the working corner **2*b*** scarcely takes place because of a large curvature radius Rd and, at the upper portion of the body of re-drawn cans, there results a thickened steel sheet due to large compression in the peripheral direction.

Distortion by the re-drawing for reducing thickness is much greater than that by the ordinary re-drawing due to compression in peripheral direction, tensile in vertical direction and compression in thickness direction. In addition, in the re-drawing for reducing thickness, thickness of the steel sheet is reduced by the bending-stretching deformation at the working corner **2*b* with a small curvature radius Rd. Upon this thickness reduction, there arises local stretching. The inventors have found that, when conventional cold-rolled steel sheet is used, there results seriously rough surface 6**, i.e., serious surface roughness and surface waviness due to the local stretching. It has also been found that this tends to be more serious as the number of times of re-drawing for reducing thickness increases and as the curvature radius Rd decreases.

In particular, in the latter stage of the re-drawing for reducing thickness, above all, in the stage of re-drawing the portion within about 20 mm from the opening end of seamless can, back tension $S_1$ becomes considerably small and liable to vary, which is considered to make the rough surface 6 more rough. This rough surface 6 becomes more serious by the bend-stretching upon neck-in flange working, which in some cases results in formation of pinholes, breaking of the material or cracking of flange.

The aluminum-killed steel sheet of claim 1, which has an average grain size of up to 6.5 μm and a solid-dissolved carbon amount reduced to 10 ppm or less than that by overaging after continuous annealing, has a large total area of grain boundary and much carbide precipitated on the grain boundary or within grains.

The grain boundary and the carbide function as the starting point of sliding face upon plastic deformation, and a number of sliding faces rapidly appear in different directions in the steel portion on the working corner **2*b*** and readily migrate without being intervened by lattice strain, which serves to smoothly complete the plastic deformation.

Figure 4:
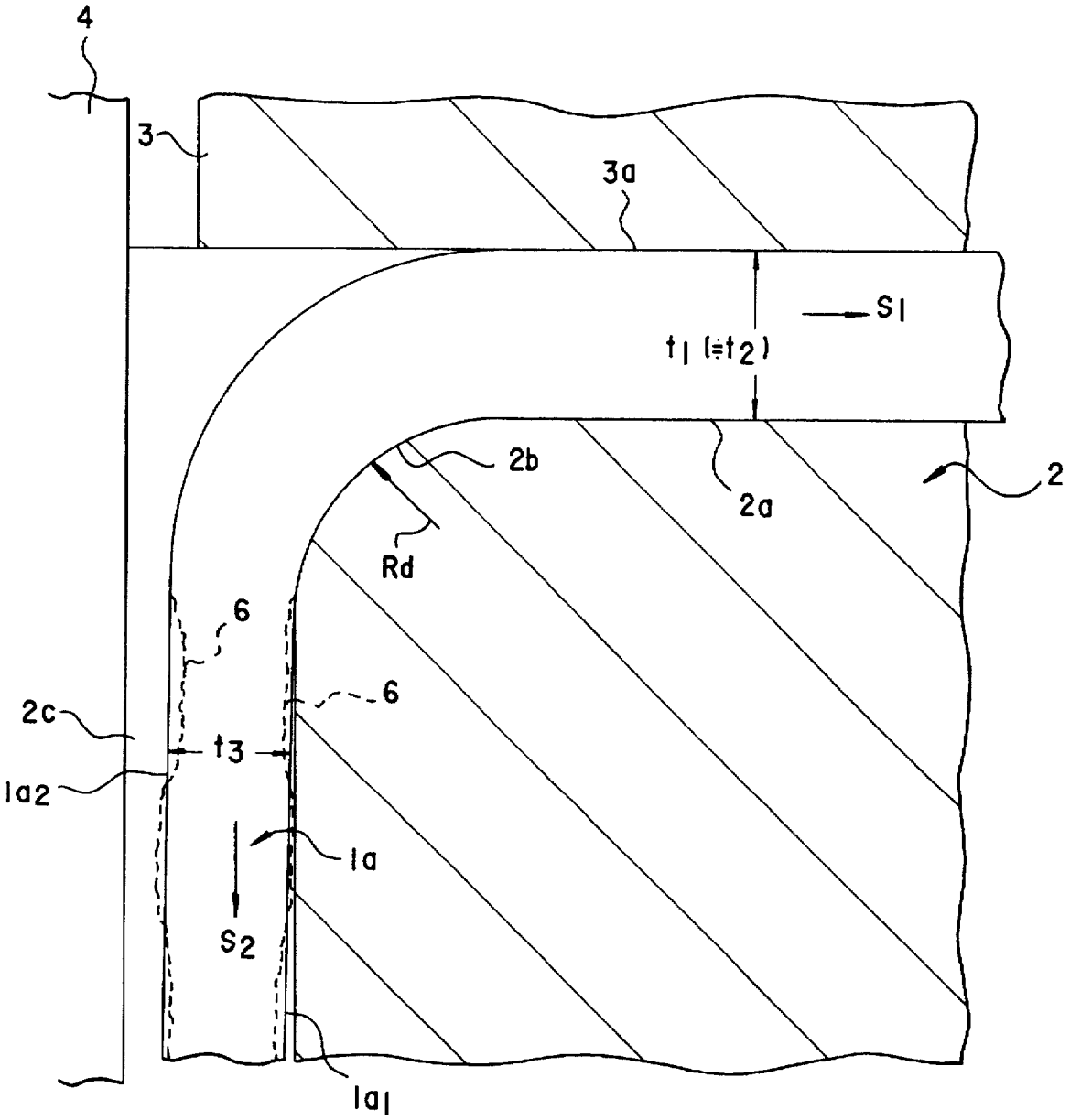
FIG. 4 is a vertical sectional view showing the step of forming the seamless can shown in FIG. 3 ③ from the re-drawn cup shown in FIG. 3 ②.

These may contribute to reduced rough surface 6 in the side wall portion **1*a* and formation of comparatively smooth outer surface $1a_1$ and inner surface $1a_2$ of the side wall (see FIG. 4**). This may serve to prevent the problems of formation of rough surface and pinholes in the necked-in portion and flange cracking upon necked-in flange working.

The total carbon amount of the steel sheet is limited to 0.01–0.13% by weight. If the amount is less than 0.01% by weight, grains will grow too much upon continuous annealing, thus average grain size not being able to be decreased to 6.5 um or less. On the other hand, if more than 0.13% by weight, the steel sheet will become so hard that longitudinal wrinkles appear around the opening and that cracking is liable to take place upon re-drawing.

The amount of dissolved carbon is limited to 10 ppm or less than that. If more than 10 ppm, lattice strain will become so serious that the above-described migration of sliding faces becomes difficult to take place, and number of precipitated carbide functioning as starting point of sliding face upon plastic deformation will become small. Steel sheets having been subjected to a batchwise annealing have the amount of dissolved carbon of 10 ppm or less, but are difficult to stably have the average grain size of up to 6.5 μm.

The thickness of the organic resin coated on the steel sheet is limited to 5–30 μm. If thinner than 5 μm, there results deteriorated corrosion resistance even surface defects such as rough surface can be prevented to some extent. On the other hand, if thicker than 30 μm, wrinkles will not be able to be prevented upon drawing or re-drawing for reducing thickness, resulting in high tendency of formation of longitudinal wrinkles.

If the overaging temperature is lower than 350° C., the averaging step requires a prolonged time, thus such temperature not being preferred in view of production efficiency. On the other hand, if higher than 500° C., the equilibrium amount of dissolved carbon atom in the steel will become so high that it becomes impossible to decrease the amount of solid-dissolved carbon to 10 ppm or less than that by the overaging, thus such temperature not being preferred.

If the amount of soluble aluminum is less than 0.01% by weight, it will become difficult to fix nitrogen atoms and, as a result, dissolved nitrogen atoms in the steel increase in number, which prevents migration of sliding faces. Thus, such amount is not preferred. On the other hand, if more than 0.1% by weight, alumina type inclusions will liable to be formed, leading to formation of cracking or like defect upon drawing, re-drawing for reducing thickness, or necked-in working. Thus, such amount is not preferred.

If the total nitrogen amount exceeds 0.006% by weight, the steel will become so hard that longitudinal wrinkles are formed around the opening or cracking is liable to take place upon re-drawing.

The present invention is now described in more detail by reference to the following Example.

EXAMPLE

Figure 1:
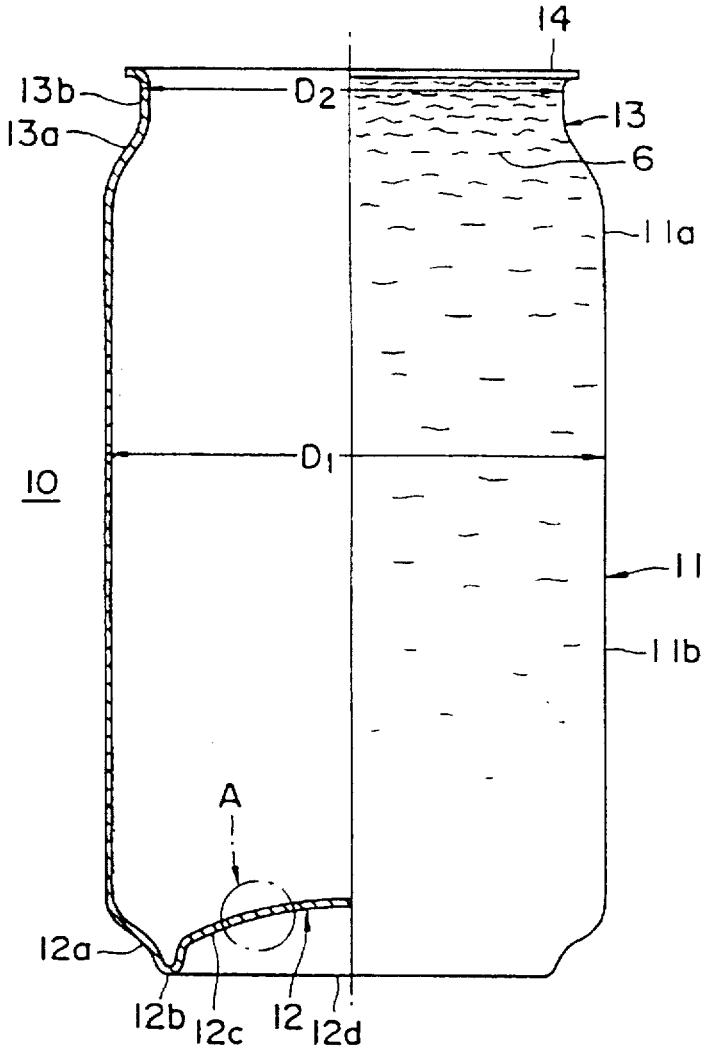
FIG. 1 is a partially cut front view of the first embodiment of a seamless can of the present invention having a necked-in portion.

FIG. 1 shows seamless can 10 with necked-in portion which is an embodiment of the present invention. Seamless can 10 has a body 11, a bottom 12, a necked-in portion 13 and flange 14. The body is generally in a cylindrical form. Bottom 12 comprises an inwardly concave chime **12*a*, a circular projection 12*b* and a central panel 12*c* inwardly concave in a dome shape, and has an excellent resistance against pressure from inside. Therefore, the seamless can 10** is suited as a pressure can for filling carbonated drinks.

A necked-in portion 13 comprises a shoulder **13*a* of a frustum shape and a neck 13*b* of a short cylindrical shape, which is of a type called a smooth necked-in portion. Thickness of the necked-in portion 13, flange 14 and an upper part 11*a* of the body is somewhat thicker than that of main body 11*b* which is a lower part of the body 11. The ratio of the minimum outer diameter of the necked-in portion (referred to as "diameter of necked-in portion" in this specification), $D_2$, to the outer diameter of the body 11** (referred to as "body diameter" in this specification), $D_1$, i.e., $D_2/D_1$ is up to 0.9, more preferably 0.7–0.85.

FIG. 2 shows an enlarged view of portion A of the central panel **12*c* of the bottom of the seamless can 10, wherein 15 desinates a surface treated steel sheet, 16 designates an inside organic resin layer, and 17 designates an outer organic resin layer. Thickness of the central panel 12*c* is substantially the same as a blank used as a material for forming the seamless can 10, or the surface treated steel sheet. Thickness of the surface treated steel sheet 15 is usually 0.1–0.4 mm, preferably 0.15–0.3 mm, and thickness of the organic resin layer 16 and 17** is 5–30 μm, preferably 10–25 μm.

As the surface treated steel sheet 15, those surface treated steel sheet for use as cans which have an excellent adhesion to the organic resin layers 16 and 17, such as a tinned steel sheet comprising a steel substrate **15*a* having formed thereon surface layer 15*b*** such as a tin layer or a chromium layer, a tin-free steel (electrolytic chromate treated steel sheet), a thin nickel-plated steel sheet, (electrically) zinc-plated steel sheet, etc., are preferably used.

The steel sheet substrate **15*a*** comprises an aluminum killed steel sheet of 0.01 to 0.13% by weight in total carbon amount and not more than 6.5 μm in average grain diameter having been subjected to over-aging after continuous annealing to adjust to not more than 10 ppm in solid-dissolved carbon amount.

As to grain diameter of the steel sheet substrate, the maximum grain diameter is preferably not more than about 15 μm, and the grains are preferably uniform in size.

Continuously annealed steel sheets (composed of aluminum killed steel) usually have a solid-dissolved carbon amount of about 30–about 40 ppm. However, the solid-dissolved carbon amount can be decreased to not more than 10 ppm by subjecting the annealed sheets to over-aging at 350°–500° C., preferably 350°–400° C. for a period of T. The over-aging period T varies depending upon the over-aging temperature but, in general, about 5 minutes at 350° C. or about 40 seconds at 450° C. The over-aging may be conducted batchwise by heating in a coil form in a separate step after the continuous annealing but, in view of attaining uniform over-aging, it is preferably conducted in a cooling step of the continuous annealing.

Secondary cold rolling ratio after the annealing and over-aging is preferably 0.5 to 40%. If less than 0.5%, stretcher strain will be liable to generate in the bottom or the like upon drawing and, if more than 40%, the steel will become too hard and fibrous tissue seriously develops in the rolling direction, which leads to formation of longitudinal wrinkles or cause breaking upon drawing or re-drawing and ironing for reducing thickness.

As the organic resin for forming organic resin layers 16 and 17, biaxially stretched polyester films are used, with polyethylene terephthalate copolymer films (e.g., ethylene terephthalate/isophthalate copolymer film of 88/12 in molar ratio) being particularly preferred. Application of the film to the surface treated steel sheet 15 is usually conducted by thermocompression bonding optionally forming an adhesive layer therebetween. The outer resin layer 17 may be formed by coating as will be described hereinafter.

The seamless can with a necked-in portion is manufactured, for example, in the following manner.

An aluminum killed steel slab consisting of 0.01–0.13% by weight of carbon, 0.01–0.1% by weight of soluble aluminum, up to 0.006% by weight of nitrogen, 0.1–1.0% by weight of Mn, and the rest of Fe and unavoidable impurities is hot rolled and wound at a temperature at which grain size can be made small and an aggregate tissue for reducing anisotropy can be optimized (about 600°–about 670° C.). The resulting hot-rolled strip is acid-washed and subjected to a primary cold rolling to produce a cold-rolled strip.

Then, the cold-rolled strip is continuously annealed at a comparatively low soaking temperature (e.g., about 650° to about 700° C.) for a short time to thereby reduce the size of grains and cooled in a cooling step to 350° to 500° C. by, for example, blowing an inert gas, then subjected to the over-aging by maintaning at the aforementioned temperature for a predetermined period of time T, followed by cooling.

Upon over-aging, it may be possible to supercool from the soaking temperature of the continuous annealing to a temperature lower than the over-aging temperature, re-heat to the over-aging temperature and, after keeping at the temperature for the predetermined over-aging time T, cool the strip or, alternatively, to supercool in the same manner and, after re-heating to the aforementioned temperature, conduct gradient over-aging by cooling to a predetermined temperature, for the purpose of effectively decreasing the amount of solid-dissolved carbon in a short time. Also, box annealing may be conducted separately at the above-described aging temperature after the ordinary continuous annealing.

The resulting continuously annealed strip is subjected to a secondary cold rolling with a thickness reduction ratio of 0.5 to 40% to obtain a secondary cold-rolled strip with a predetermined thickness. This secondary cold-rolled strip is electrically cleaned, then surface treated to produce a surface treated strip of, for example, tin-free steel. A 5–30 μm thick organic resin layer is applied to both sides of the surface treated strip by thermocompression bonding or the like to produce a resin-coated steel strip having a cross-sectional structure as shown in FIG. 2.

Figure 3A:
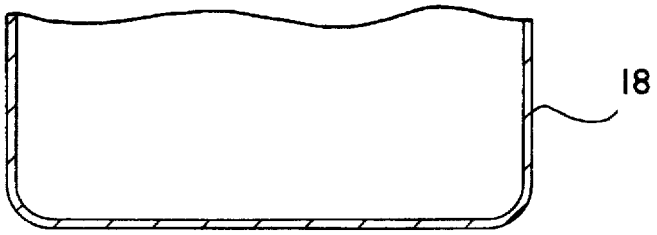
FIG. 3 ① is a vertical sectional view of shallowly drawn cup, ② a re-drawn cup formed from the shallowly drawn cup, and ③ a seamless can formed from the re-drawn cup and before formation of the necked-in portion of the seamless can shown in FIG. 1.
Figure 3B:
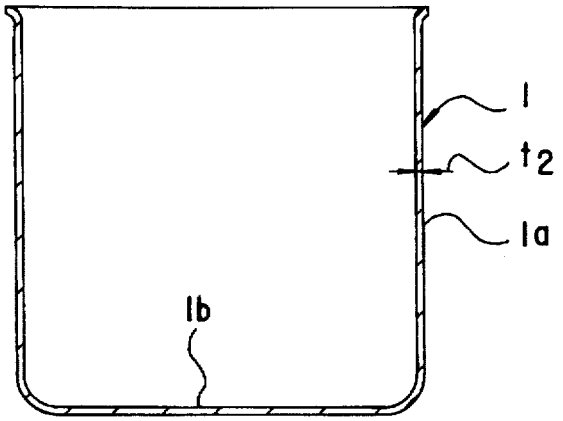
Figure 3C:
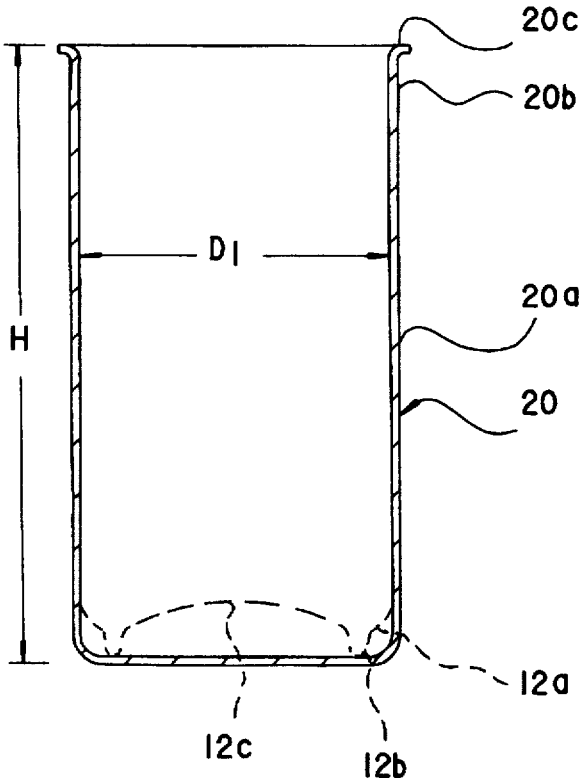

The resin-coated steel strip is introduced into a drawing machine (not shown) to conduct blanking and drawing, thus a shallowly drawn cup 18 as shown in FIG. 3 ① being formed. Subsequently, the shallowly drawn cup 18 is re-drawing by a transfer press to form a re-drawn cup 1 (FIG. 3 ②). The cup 1 is then re-drawn for reducing thickness by cooperation of a re-drawing die 2 for reducing thickness, a blank holding member 3 and a punch 4 shown in FIG. 4 to form a seamless can 20 having a body diameter of $D_1$ and a flange 20*c*. Then, the bottom of the seamless can 20 is worked to form a chime 12*a*, a circular projection 12*b* and a central panel 12*c*.

Figure 5A:
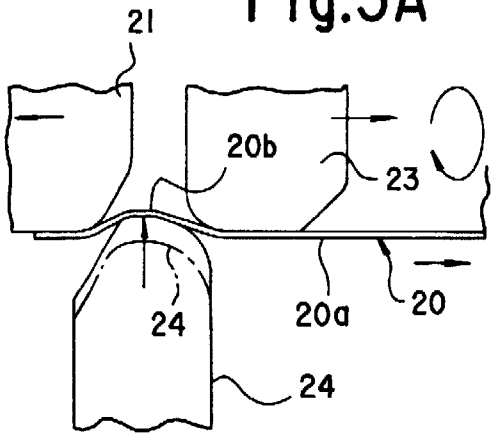
FIG. 5 is a vertical sectional view showing the step of forming the necked-in portion and the flange from the seamless can shown in FIG. 3 ③.
Figure 5B:
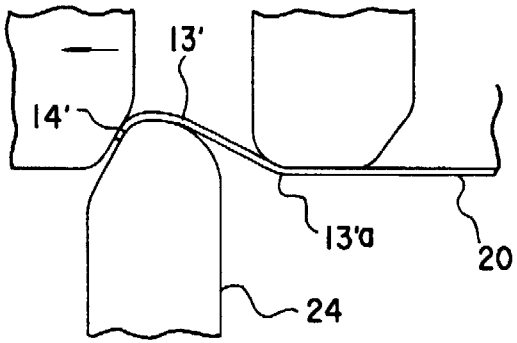

The upper part of a side wall 20*a* is cut off from the bottom-worked seamless can 20 together with the flange 20*c*, and the outer surface is printed. Subsequently, as is shown in FIG. 5, seamless can 20 is forcibly rotated on a rotating support 21 inserted into the opening end 20*b*, and a forming roll 24 is moved from the position shown by one-dotted chain dash toward the side wall 20*a* so as to be pressed against the opening end 20*b* located between the rotating support 21 and a work roll 23 which is eccentrically provided in contact with the inside surface of the side wall 20*a* in the vicinity of the rotating support 21 and which has a smaller diameter than the rotating support 21 while the side wall 20*a* is moved apart from the rotating support 21 in the axial direction together with the work roll 23 (FIG. 5 ①), thus pre-necked-in portion 13' and pre-flange 14' (FIG. 5 ②).

Then, the pre-necked-in portion 13' and the pre-flange 14' are worked by a working tool (not shown) to form a shoulder 13*a* having an arc-shaped cross-section and a flange 14 substantially parallel to the bottom plane 12*d*.

Experimental examples are described below.

As is shown in Table 1, tin-free steels composed of aluminum killed steel (Al content:0.04–0.07% by weight; total nitrogen amount:0.002–0.005% by weight; amount of solid-dissolved nitrogen: up to 1 ppm) having varying amounts of carbon, varying amounts of solid-dissolved carbon and varying average grain diameter and having a thickness of 0.175 mm and a secondary cold-rolling ratio of 30% were prepared. A 20-μm thick ethylene terephthalate/isophthalate copolymer (molar ratio: 88/12) film was provided by thermocompression bonding on each side of the steel strips. Circular blanks of 166 mm in diameter were blanked from the resin-coated strips, and seamless cans 20 having a height, H, of 125 mm, a body diameter, $D_1$, of 66 mm (corresponding to nominal can diameter of #211) and an average thickness of the side wall 20*a* (including the organic resin layers) of 0.14 mm were produced by the drawing-re-drawing for reducing thickness. Additionally, curvature radius Rd of the working corner 2 of the re-drawing die 2 was 0.3 mm.

For comparison, seamless cans 20 of the same size as described above shown in Table 1 were produced under the same working condition as described above using tin-free steels and resin-coated steel strips prepared under the same conditions as described above except for not conducting the over-aging.

The amount of solid-dissolved carbon was measured in the following manner.

Solid-dissolved carbon is precipitated on carbide by a thermal treatment of 250° C.×50 hours. Electric resistance is measured before and after the thermal treatment to obtain a decrease in electric resistance corresponding to the precipitation of solid-dissolved carbon on carbide. The decrease is converted into the amount of solid-dissolved carbon by using a contribution ratio of solid-dissolved carbon per unit concentration to specific resistance, 29.5 μΩ cm/% by weight. (For example, see H>Abe et al; Trans. Iron steel Inst. Jpn., 21 (1981), p.100). Samples were cut out from the body of can.

Surface waviness (WCa: cut-off value: 0.16–1.6 mm) of the inside surface of flange 20*c* of these seamless cans 20 and at a part about 20 mm downward from the top surface was measured according to the filter manner described in JIS B 0610. The results thus obtained are shown in Table 1.

These seamless cans were subjected to the necked-in working and flange working according to the spinning method (can rotation number: 2500 rpm) and die-pressing method to form seamless cans 10 with necked-in portion.

With respect to pre-necked-in portion 13' before being subjected to spinning, diameter reduction ratio at breakage $\{(D_1-D_2)\times 100/D_1\%\}$, maximum ratio of thickness reduction at a diameter reduction ratio of 16% (corresponding to nominal diameter of #204; $D_2$=55.2 mm), breaking generation ratio of the necked-in portion, enamel rater value of cans (ERV; measured according to the method described in "Hoso Gijutu Binran (Wrapping Technology Handbook)", published by Nikkan Kogyo Shinbunsha on Jul. 20, 1983, p.1845), and corrosion resistance evaluated by filling them with cola and sealing them and leaving at 37° C. for 6 months were measured. Results thus obtained are also shown in Table 1.

With a sample of 0.14% by weight in the total carbon amount, longitudinal wrinkles were formed at the end of the opening, formation of the necked-in portion being impossible.

In the corrosion resistance test, samples showing no abnormality were rated as A, samples suffering spot-like corrosion in the upper part 11*a* of the body as C, and samples suffering serious corrosion in the upper part 11*a* of the body as B.

TABLE 1

| Over-aging | Total C Amount wt % | Amount of Solid-dissolved C ppm | Grain Diameter μm | *1 | *2 | *3 | *4 | ERV mA | *5 |
|---|---|---|---|---|---|---|---|---|---|
| yes | 0.03 | 5.5 | 6.2 | 23 | 11 | 0 | 0.83 | 0.0 | A |
| yes | 0.06 | 6.2 | 5.3 | 22 | 12 | 0 | 0.72 | 0.0 | A |
| yes | 0.10 | 6.5 | 4.2 | 22 | 12 | 0 | 0.65 | 0.0 | A |
| no | 0.03 | 30 | 6.4 | 17 | 18 | 20 | 1.24 | 3.1 | C |
| no | 0.06 | 31 | 5.6 | 19 | 16 | 15 | 1.05 | 0.3 | B |
| no | 0.10 | 33 | 4.5 | 19 | 14 | 15 | 0.96 | 0.4 | B |
| no | 0.002 | 5.1 | 9.2 | 15 | 16 | 20 | 1.13 | 7.0 | C |
| no | 0.14 | 40 | 4.0 | 10 | * | 100 | 1.02 | 12.5 | — |

*1: Maximum diameter reduction ratio, %
*2: Thickness reduction ratio, %
*3: Breaking generation ratio, %
*4: Surface waviness, μm
*5: Corrosion resistance
*It was impossible to reduce diameter.

Figure 6:
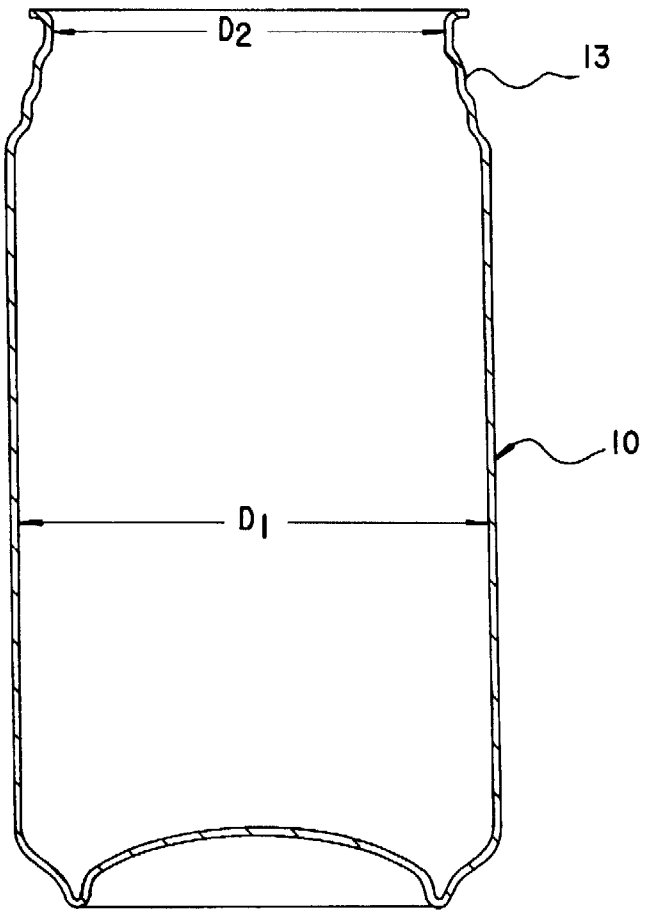
FIG. 6 is a vertical sectional view showing the seamless can with a necked-in portion obtained in the second embodiment of the present invention.

This invention is not limited in any way by the above-described examples. For example, the necked-in portion may be multi-stepped by die forming (three-stepped embodiment being shown as necked-in portion 13 in FIG. 6). In this case, too, $D_2/D_1$ is not more than 0.9. The cut to be subjected to re-drawing for reducing thickness may be a shallowly drawn cup 18 (FIG. 3, ①).

Figure 7:
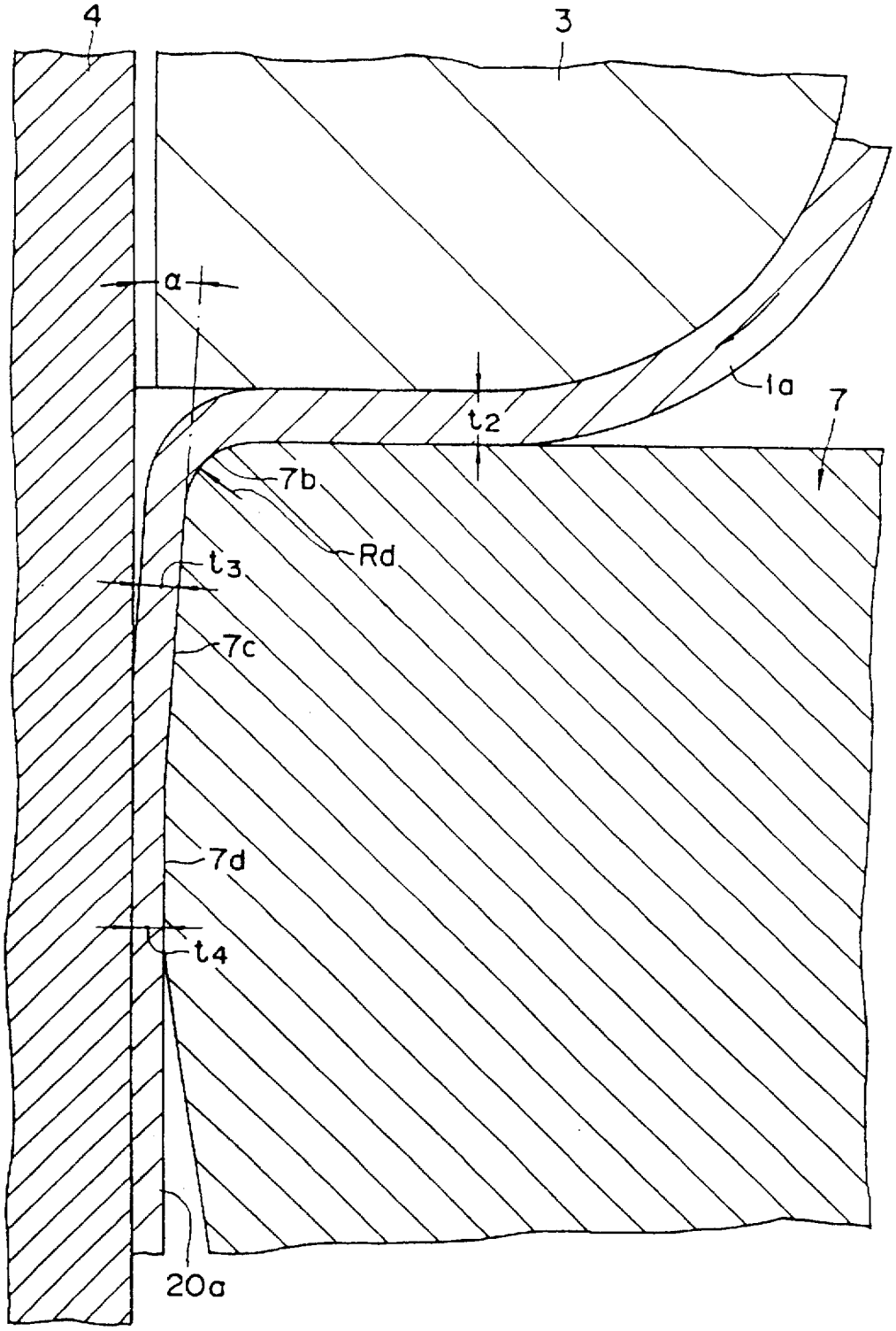
FIG. 7 is a vertical sectional view showing a second example of the step of forming the seamless can shown in FIG. 3 ③ from the re-drawn cup shown in FIG. 3 ②.

For example, as is shown in FIG. 7, a seamless can 20 having a side wall 20*a* of $t_4$ in thickness may be formed by subjecting the side wall 1*a* of the re-drawn cup 1 to the re-drawing-ironing for reducing thickness using a die 7 for the re-drawing-ironing having a working corner 7*b*, approach surface 7*c* of an inverse frustum shape extending forward and slantward at an angle of α to the axis of die cavity, and an ironing part 7*d* of a short cylindrical shape in contact with the lower end of the approach surface 7*c*. This embodiment provides the advantage that the side wall 20*a* of the formed seamless can 20 can be more thinned and that thickness can be easily controlled.

In the ironing, said re-drawn side wall 20*a* is ironed with an ironing ratio of at least 5%, preferably 10–40%. Referring to FIG. 7, the ratio can be represented as follows:

$$\frac{t3-t4}{t3}\times 100(\%)$$

wherein t3 is a thickness of the steel plate before being entered in a die and t4 is a thickness of the steel plate after being taken out of the die. The ironing enables one to more reduce and control the thickness of the side wall 20*a* of the seamless can 20 and, since the organic layers are smoothed, there is obtained an improved printability, and formation of rough surface is effectively prevented.

If the ironing ratio exceeds 40%, there will arise delamination or breaking of the organic layers due to too much ironing.

Additionally, in FIG. 7, the same symbols as in FIG. 4 designate the same components.

As the organic resin, there are illustrated thermoplastic resin films such as olefinic resins such as polyethylene, polypropylene, ethylene-propylene copolymer, ethylene-vinyl acetate copolymer, ethylene-acrylic ester copolymer and ionomer; films of polyesters such as polybutylene terephthalate; films of polyamides such as nylon 6, nylon 6,6, nylon 11 and nylon 12; a polyvinyl chloride film; a polyvinylidene chloride film; etc. These films may or may not be biaxially stretched.

In the case of using an adhesive upon lamination, an urethane adhesive, an epoxy adhesive, an acid-modified olefinic resin adhesive, a copolyamide adhesive, a copolyester adhesive, etc. may preferably be used in a thickness of 0.1 to 5.0 μm.

In addition, a thermosetting paint may be applied to the surface treated steel sheet or to the film in a thickness of 0.05–2 μm as the adhesive.

Further, as the organic resin, thermoplastic or thermosetting paints such as modified epoxy paints (e.g., phenol-epoxy, amino-epoxy, etc.), vinyl chloride-vinyl acetate copolymer, saponified vinyl chloride-vinyl acetate copolymer, vinyl chloride-vinyl acetate, maleic anhydride copolymer, epoxy-modified, epoxyamino-modified or epoxyphenol-modified vinyl paints, acrylic paints, synthetic rubber paints (e.g., styrene-butadiene copolymer, etc.) may be used alone or in combination of two or more.

The seamless can with a necked-in portion in accordance with the present invention enables one to use a can top having a comparatively small diameter, thus production cost being reduced. In addition, the can shows an excellent corrosion resistance against its contents.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An organic resin-coated seamless can with necked-in portion, which is produced by subjecting a resin-coated steel sheet to drawing-re-drawing for reducing thickness or to drawing-re-drawing-ironing for reducing thickness and which has a ratio of diameter of necked-in portion to diameter of body of 0.9 or less, said steel sheet being coated by 5- to 30-μm thick organic resin layer on both surfaces of aluminum-killed, surface treated steel sheet of 0.01 to 0.13% by weight in total carbon amount and not more than 6.5 μm in average grain diameter having been subjected to over-aging at 350°–500° C. after continuous annealing to adjust to not more than 10 ppm in solid-dissolved carbon amount and a nitrogen content not exceeding 0.006% by weight.

2. The seamless can with necked-in portion as set forth in claim 1, wherein soluble aluminum is contained in an amount of 0.01–0.1% by weight.

3. The seamless can with necked-in portion as set forth in claim 1, wherein said can is drawn-re-drawn-ironed resulting in an ironing ratio of at least 5%.

4. The seamless can with necked-in portion as set forth in claim 1, wherein said can is drawn-re-drawn-ironed resulting in an ironing ratio of 10 to 40%.

* * * * *